United States Patent [19]

Koehn et al.

[11] 4,073,280

[45] Feb. 14, 1978

[54] RAPID FIRE GUN

[76] Inventors: Wilbur R. Koehn, 160 Main St., Port Washington, N.Y. 11050; John H. Detwiler, 71 Ridge Crescent, Manhasset, N.Y. 11030

[21] Appl. No.: 644,518

[22] Filed: Dec. 29, 1975

Related U.S. Application Data

[62] Division of Ser. No. 730,736, May 21, 1968, Pat. No. 3,996,916.

[51] Int. Cl.[2] ..... F41B 11/02

[52] U.S. Cl. ..... 124/72; 124/83

[58] Field of Search ..... 124/41 R, 49, 50, 51 R, 124/51 A, 52, 53, 56, 62, 63, 64, 65, 66, 67, 68, 69, 70, 71, 72, 73, 74, 75, 76, 77, 81, 82, 83, 45; 42/1 R, 76 R, 77, 78; 89/1 R, 14 R, 7, 37.5 B

[56] References Cited

U.S. PATENT DOCUMENTS

| | | | |
|---|---|---|---|
| 565,423 | 8/1896 | Beck et al. | 124/62 |
| 1,099,554 | 6/1914 | La Sares | 124/49 X |
| 1,187,218 | 6/1916 | Wister | 42/1 R |
| 2,460,924 | 2/1949 | Dally | 124/62 |
| 2,512,313 | 6/1950 | Dritz | 124/62 X |
| 2,729,207 | 1/1956 | Foster | 124/51 A UX |
| 3,089,476 | 5/1963 | Wolverton | 124/51 A X |
| 3,100,358 | 8/1963 | Robinson, Jr. | 42/78 |
| 3,177,862 | 4/1965 | Allemann | 124/51 R X |
| 3,388,696 | 6/1968 | Hoverath et al. | 124/62 |

*Primary Examiner*—Richard T. Stouffer
*Attorney, Agent, or Firm*—Curtis, Morris & Safford

[57] ABSTRACT

A gun for rapidly firing projectiles from a package inserted into a magazine as a cartridge and which are automatically fed into a propelling chamber and barrel connected thereto by a continuous stream of high pressure gas, a portion or all of which flows through the magazine. The flow of propellant gas is started and stopped by a manually or automatically controlled gate and the rate of firing and muzzle velocity of the projectiles are controlled by varying the pressure of the propellant gas, the geometry of the propelling chamber, or both. The magazine is so shaped as to deliver projectiles into the propelling chamber successively and the propelling chamber is so shaped as to direct the projectiles forwardly therein and form alternating slugs of gas and projectiles. The outlet from the propelling chamber may be connected through a flexible tube or directly to a curved or a conventional barrel. If a curved barrel is used, one of the surfaces of the interior of the curved barrel and exterior of the projectiles is formed to induce a rotary motion to the projectile as it passes through the curved barrel. The propellant gas may be carried in a gas container as a compressed gas, or in liquid form, or it may be generated as required by chemically generated gas. The gun may be carried on the person, it may be mounted in a fixed position, or it may be mounted on a vehicle, ship or aircraft.

5 Claims, 19 Drawing Figures

FIG. 4
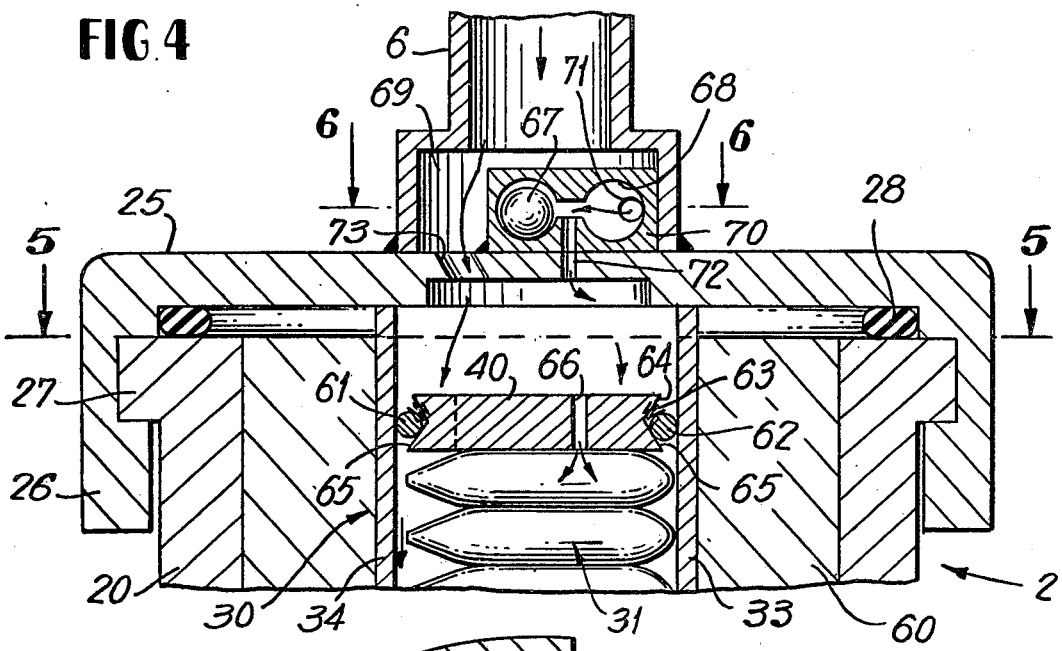
FIG 5
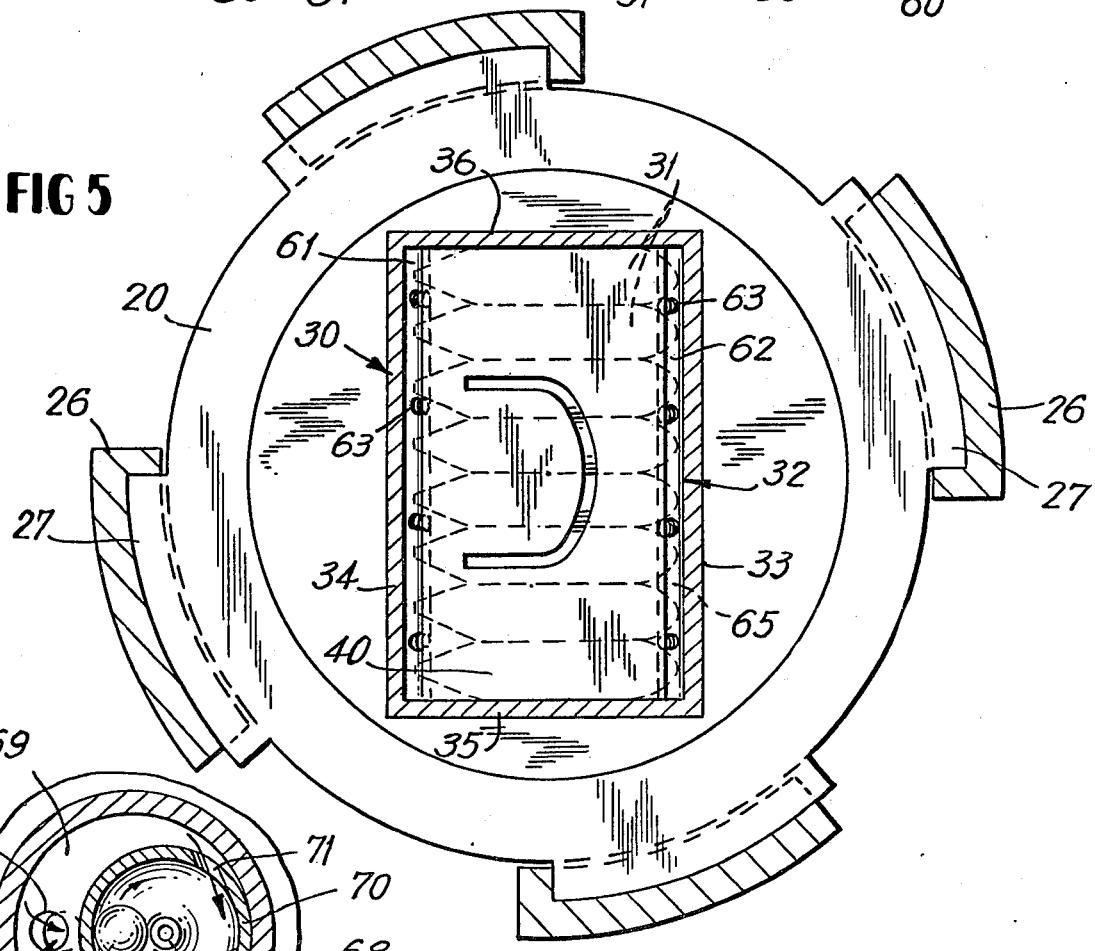
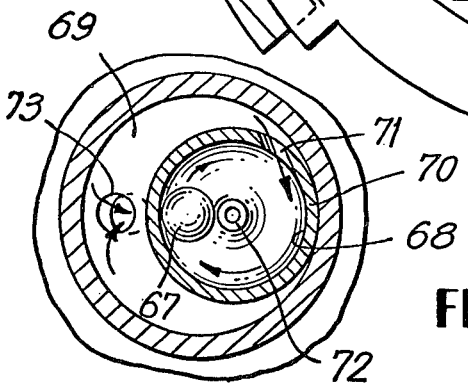
FIG. 6

FIG. 9
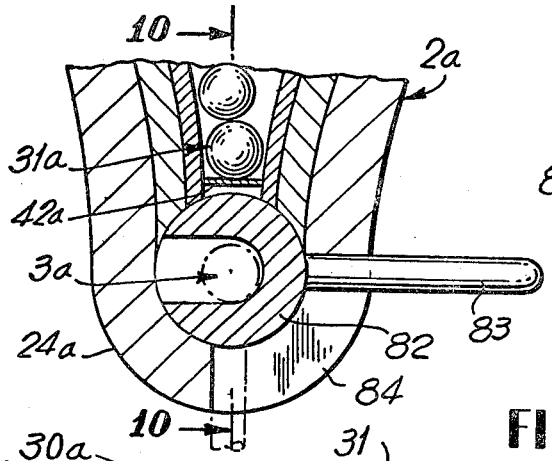
FIG. 7
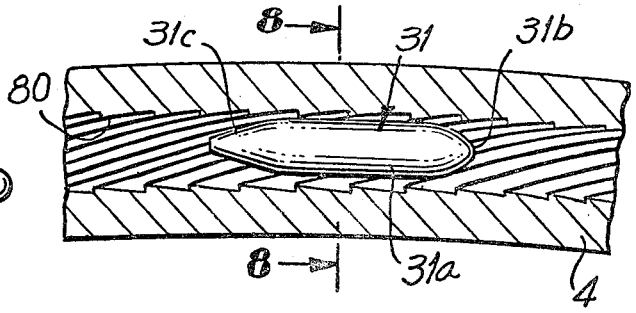
FIG. 10
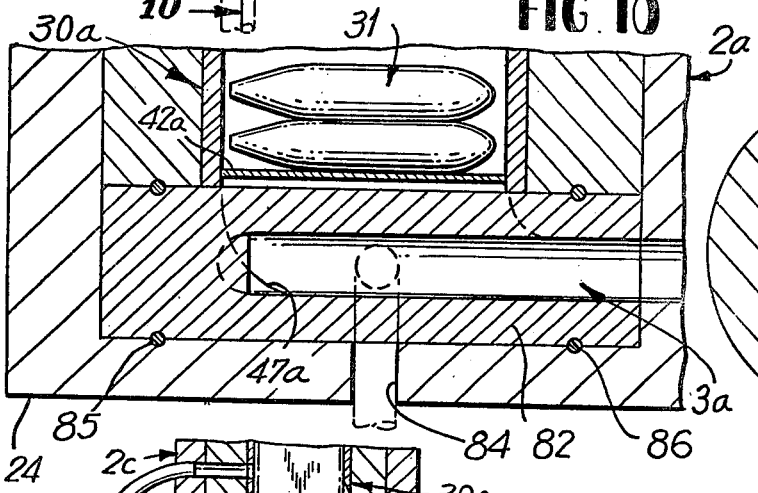
FIG. 8
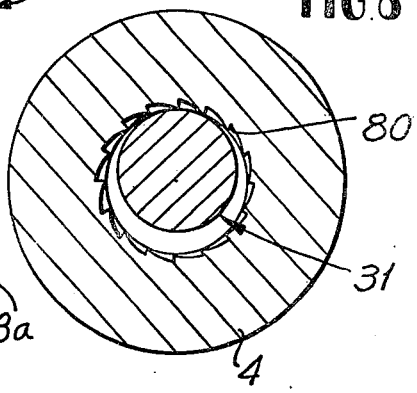
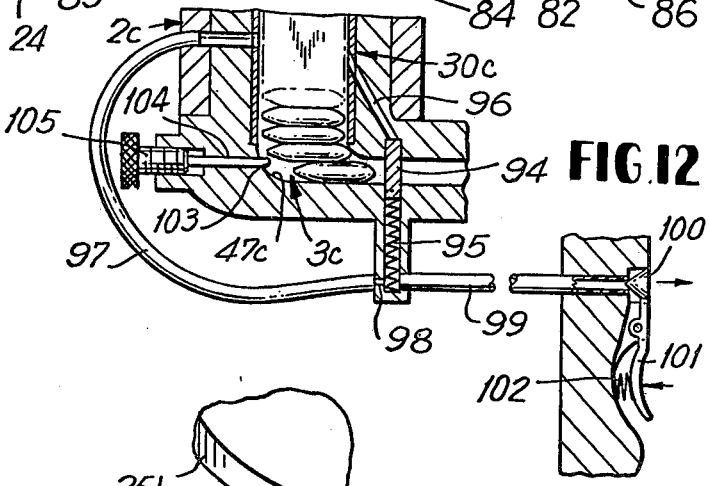
FIG. 12
FIG. 11
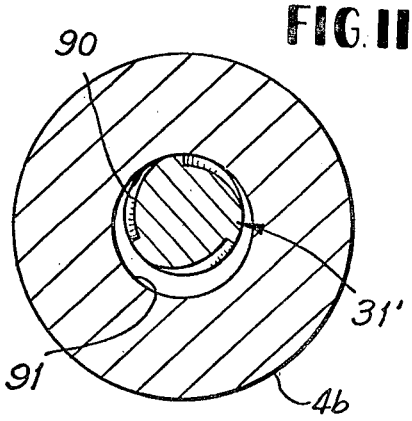
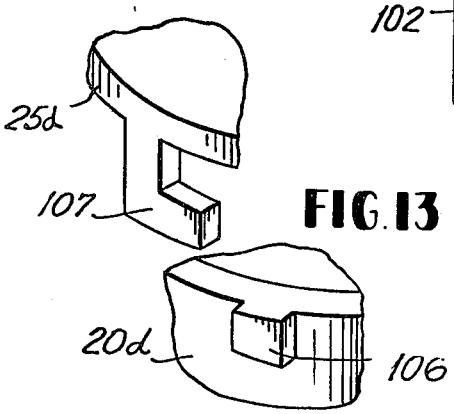
FIG. 13

RAPID FIRE GUN

This is a division of application Ser. No. 730,736, filed May 21, 1968, now U.S. Pat. No. 3,996,916.

The present invention relates to guns and more particularly to a rapid-fire gun in the nature of a rifle.

The most common ordnance pieces carried by soldiers are conventional rifles and carbines. Conventional guns have definite limitations as to the number of rounds which can be fired in a given period of time. More specifically, such guns have substantial cost, volume, and weight limitations arising from the use of separate cartridge cases, primer and propellant charges with each individual projectile, and their reliability is limited by their dependence upon breech operating mechanisms with many moving parts.

Rapid fire machine guns also are commonly used, but this type of gun has the same limitations as explained with respect to rifles and carbines. In other words, if the gun is fired too rapidly the barrel is apt to over-heat and jam, and the faster the gun is fired the quicker the supply of ammunition is exhausted and the moving part of its breech operating mechanism mechanically limits its speed of operation. Usually additional men and equipment also are required to operate a machine gun, and especially to carry an adequate supply of ammunition.

One of the objects of the present invention is to provide an improved light weight gun which may be fired at a much more rapid rate than conventional guns without danger of over-heating.

Another object is to provide a rapid fire gun which greatly increases the number of projectiles that can be carried on the person using the gun as well as the number of projectiles that can be loaded in the gun at one time as a self-contained package.

Another object is to provide a rpaid fire gun in which projectiles are automatically fed to the barrel of the gun without any moving parts.

Another object is to provide a rapid fire gun having an improved barrel construction for rotating the projectiles as they more through the barrel.

Another object is to provide a rapid fire gun of the type indicated which uses an expanding high pressure gas as a propellant and thereby eliminates the necessity of cartridge casings and powder.

Another object is to provide a rapid fire gun of the type indicated in which the velocity and rate of fire may be adjusted by adjusting the pressure of the propellant gas or geometry of the propelling chamber.

Another object is to provide a rapid fire gun of the type indicated which may be adapted to many applications such as jet aircraft and which may utilize the pressurized gas generated by or supplied to a jet engine to operate the gun.

Still another object is to provide a rapid fire gun of the type indicated which is of relatively simple and compact construction in order to minimize manufacturing costs and to assure a high degree of reliability in operation.

These and other objects will become more apparent from the following description and drawings in which like reference characters denote like parts throughout the several views. It is to be expressly understood, however, that the drawings are for the purpose of illustration only and are not a definition of the limits of the invention, reference being had for this purpose to the appended claims.

In the drawings:

FIG. 4 is a further enlarged sectional view of the top section of the magazine illustrated in FIG. 3 and showing a vibrator and follower for advancing projectiles through the magazine;

FIG. 5 is a transverse sectional view taken on line 5—5 of FIG. 4 to show the self-contained package of projectiles in the magazine and the slot in the top of the follower through which propellant fluid passes;

FIG. 6 is a transverse sectional view taken on line 6—6 of FIG. 4 to show the rotating ball of the vibrator;

FIG. 7 is an enlarged sectional view of a portion of the curved barrel showing the rifling in the barrel;

FIG. 8 is a transverse sectional view taken on line 8—8 of FIG. 7 to show the contour of the rifling lands;

FIG. 9 is an enlarged transverse sectional view of a propelling chamber of modified construction and showing the bottom of the magazine and propelling chamber having a breech opening therein;

FIG. 10 is a sectional view taken on the line 10—10 of FIG. 9 and showing the propelling chamber in a separate cylinder rotatable independently of the barrel for starting and stopping operation of the gun;

FIG. 11 is a transverse sectional view like FIG. 8 showing a modified construction in which the barrel has a smooth bore and the rifling is formed on the periphery of the projectile;

FIG. 12 is a view similar to FIG. 3 showing a mofified construction including an adjustable surface at the rear of the propelling chamber for advancing projectiles and a trigger for controlling operation of a gate valve between the propellant chamber and barrel;

FIG. 13 is a detail view of a detachable locking arrangement of modified construction for connecting the detachable cover to the housing of the magazine;

Figures 1, 2, 3:
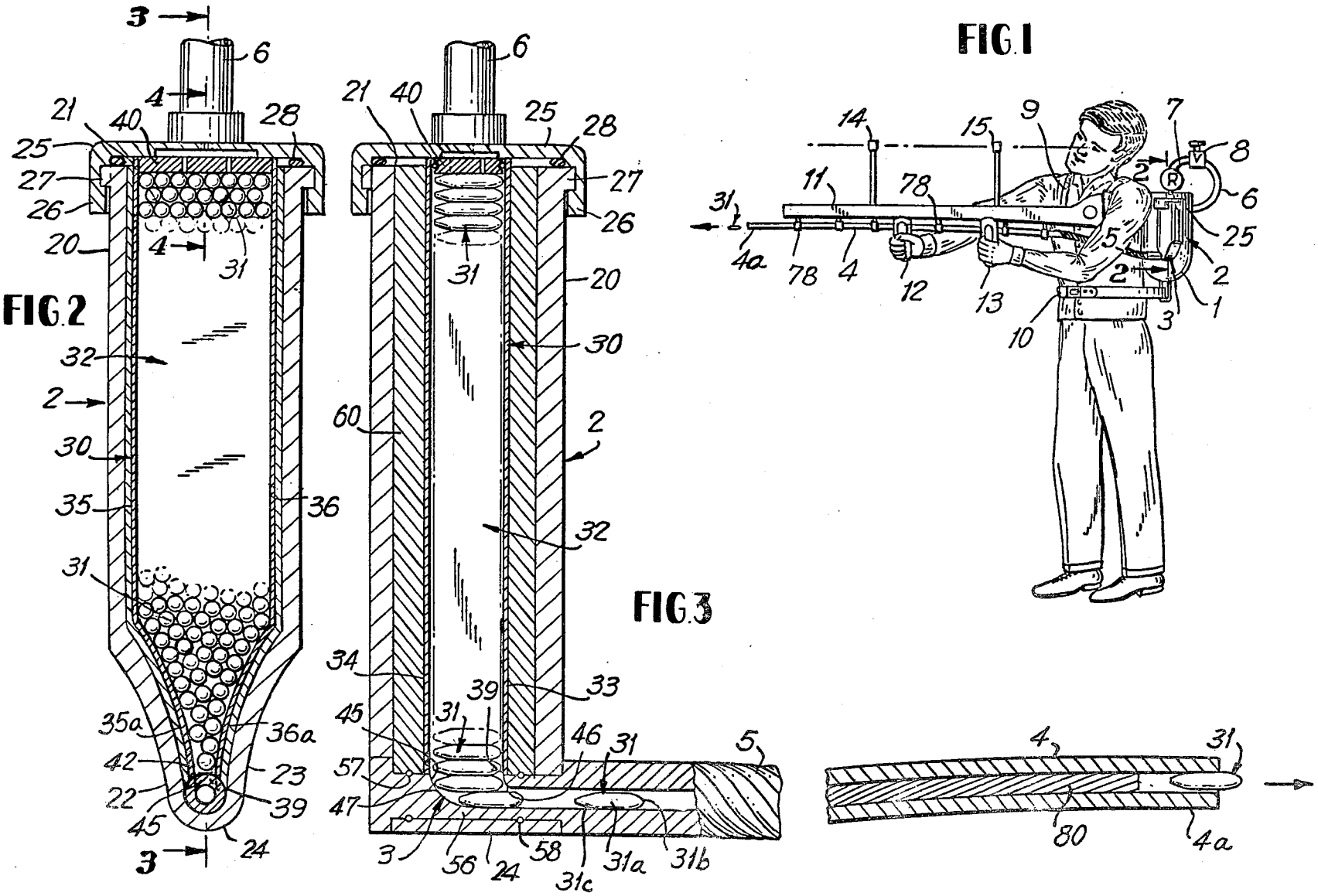
FIG. 1 illustrates a gun adapted to be carried on the person and incorporating the novel features of the present invention.
FIG. 2 is an enlarged sectional view taken on the line 2—2 of FIG. 1 to show the magazine for projectiles and propelling chamber adjacent the outlet from the magazine.
FIG. 3 is a sectional view taken on line 3—3 of FIG. 2 and showing the path of flow of propellant and projectiles through the magazine, propelling chamber and barrel of the gun.

Referring now to the drawings, a gun incorporating the novel features of the present invention is shown in FIG. 1 as comprising a source of pressure fluid 1, a magazine 2 for projectiles to which high pressure air is supplied from the source 1, a propelling chamber 3 adjacent the outlet from the magazine, a barrel 4 through which the projectiles are fired, and a flexible tube 5 connecting the outlet from the propelling chamber 3 to the rearward end of the barrel 4. The source of pressure fluid 1 in the embodiment illustrated in FIG. 1 is a tank and is connected to the magazine 2 through a tube connection 6 having a pressure regulator 7 therein. While not shown in detail, the pressure regulator 7 is adjustable to vary the outlet pressure and thereby vary the rate of fire and muzzle velocity of the projectiles leaving the end of barrel 4. A stop valve 8 also is provided in the connection 6 for disconnecting the source of pressure fluid 1 from the magazine 2 so that the latter may be opened for reloading with a package or packages of projectiles inserted in the manner of a cartridge. Any suitable propellant fluid may be used, such as compressed air, but preferbly we use helium because it has a lower viscosity and drag, or chemically generated gas having good operating characteristics for either reducing the weight of the gun or its configuration.

While the gun may have other applications, for purposes of illustration it is shown in FIG. 1 as a self-contained unit adapted to be carried on the person. To this end, the high pressure propellant tank 1, magazine 2, chamber 3, pressure regulator 7 and stop valve 8 are connected together to form a back pack having shoulder straps 9 and a belt 10. The barrel 4, in turn, is suspended from a stock 11 adapted to be held against the shoulder and having hand grips 12 and 13. Sights 14 and 15 project upwardly from the stock for aiming the gun at a target. The outlet from the propelling chamber 3 of the back pack is connected to the barrel 4 by the flexible tube 5 extending forwardly under the arm of the wearer.

The magazine 2 is shown in FIGS. 2 and 3 as comprising a housing 20 of generally cylindrical shape having an open top 21 and curved converging sides 22 and 23 at its lower end which join each other in a curved strap 24 forming a rectangular outlet of a length and width greater than the length and width of the projectiles to be fired and a cylindrical space adjacent the outlet. The open top of the housing 20 is closed by a cover 25 which may be attached by any suitable fastening mean such as screw threads. In the illustrated embodiment, separate interrupted flanges 26 and 27 are provided on the housing 20 and cover 25 which pass by each other when the parts are moved axially and interlock when the parts are turned relative to each other. A gasket 28 is provided between the upper edge of the wall of the housing 20 and the cover 25 to seal the joint therebetween. Tube 6 from the source of high pressure fluid 1 is connected to the cover 25 and when the latter is in closed position on the housing 20 they form a pressure vessel capable of withstanding pressures of up to, for example, 15,000 psi. The magazine 2 also includes a package 30 of projectiles 31 insertable in and removable from the housing 20 as a cartridge.

The projectiles 31 may have any suitable shape, and preferably should have a stream-lined contour to operate most efficiently. However, to adapt them to be packed in the package 30, they have the same general shape as a conventional rifle bullet comprising a cylindrical body section **31*a* between an ogive shaped head end 31*b* and a frusto-conical boat tail and 31*c*. This construction permits a mass of the projectiles to be stacked in parallel side-by-side relationship in a package in the manner illustrated in FIGS. 2 and 3**.

The package 30 comprises a casing 32 having spaced parallel front and back walls 33 and 34 and opposed side walls 35 and 36 between the edges of the front and back walls to hold the latter spaced a distance slightly greater than the length of the projectiles 31. The front, back and side walls 33, 34, 35 and 36 from a generally rectangular container for a substantial portion of their length, but the side walls 35 and 36 have curved sections **35*a* and 36*a* adjacent their lower ends which conform to the converging side walls of housing 20 to provide an outlet opening 39 slightly longer than a projectile 31. The curved sections 35*a* and 36*a* of the side walls converge from the maximum width of the package down to a width at the lower end alightly greater than the width of a projectile 31. The curvature of the sections 35*a* and 36*a* may be varied to provide any shape which will permit the free flow of projectiles toward the outlet opening 39, but after considerable experimentation the curved relation illustrated in FIG. 2** has been found to be the most satisfactory in operation.

The outlet opening 39 from the package 30 and magazine 2 is initially closed by a frangible closure 42. The upper end of the package 30 is closed by a follower 40, which, together with the frangible closure 42, maintain the projectiles in their closely packed parallel relationship illustrated in FIGS. 2 and 3 in any position of the package in or out of the magazine 2. It will be understood that when the interior of the magazine 2 and package 30 are subjected to propellant fluid at high pressure, the frangible closure 42 illustrated in FIG. 2 will break out of the package and form the outlet opening 39 as illustrated in FIG. 3 through which the projectiles may flow into the propelling chamber 3.

The propelling chamber 3 is positioned adjacent the outlet 39 from the magazine 2, and in the illustrated embodiment is shown underlying the magazine. It will be understood, however, that the magazine 2 and chamber 3 may be turned at an angle from the position illustrated in FIG. 2 and operate in the manner hereinafter described. The propelling chamber 3 is of a generally rectangular shape but may have a forward edge conforming to the contour of the forward end of the projectile with a semi-cylindrical bottom wall conforming to the shape of the side of the projectiles 31 and has a breech opening 45 at one side adjacent to and aligning with the outlet opening 39 from the magazine 2. The chamber 3 has a peripheral wall 46 forwardly of the breech opening 45 which forms a continuation of the wall 33 of the package casing 32 and spaced from the rearward wall 34 of the magazine a distance generally equal to the length of the projectile 31. The propelling chamber 3 may have the same general shape as the outlet opening from the magazine 2 with a rear wall forming a continuation of the rear wall of the magazine but it has been found that the gun operates more reliably if a forwardly curved rear wall 47 is provided in the chamber which, at its upper edge, is spaced from the forward peripheral wall 46 a distance slightly greater than the length of a projectile, but at its lower edge is spaced a distance less than the length of the projectile. Thus, the rearward end of each projectile delivered from the magazine 2 into the chamber 3 under pressure, engages the forwadly curved rear wall 47 of the chamber 3 which thrusts the projectile forwardly to position its forward end into the peripheral wall 46 forwardy of the breech opening 45 and thereby captures the projectile in the stream of flowing propellant.

The propelling chamber 3 in the illustrated embodiment is shown as a part of the inflexible rearward end 56 of the flexible tube 5 rotatable in the correspondingly shaped cylindrical opening in the lower end of the magazine housing 20 formed by the strap 24 and sealed at opposite ends by O-rings 57 and 58. To this end, the cylindrical end 56 of the flexible tube 5 has an annular recess formed in its periphery in which the strap 24 fits to prevent longitudinal movement of the tube relative to the housing 20 and provide a rotatable bearing surface. Tube 5 may be manually rotated in the housing 20 by rotating the barrel 4 to which said tube is connected and forming a continuation thereof. Thus, the rotatable end 56 of tube 5 constitutes a manually operable shut-off gate between the outlet from the magazine 2 and breech opening 45 in the chamber 3 for starting and stopping the flow of gas and operation of the gun. It will be understood, however, that other forms of gate may be provided for starting and stopping operation of the gun which may be located between the magazine and chamber or between the chamber 3 and barrel 4.

As shown more in detail in FIGS. 4 and 5, the self-contained package of projectiles 30 may be inserted as a cartridge unit into a rectangular opening in the magazine 2 formed by filler blocks 60 in the cylindrical housing 20. The follower 40 is illustrated as a rectangular plate having two end walls which closely fit the end walls 35 and 36 of the magazine 2 and side walls adjacent the side walls 33 and 34 of the magazine and having spring-pressed one-way rollers 61 and 62 at their edges. Springs 63 act between inclined shoulders 64 at the sides of the follower 40 to press the rollers 61 and 62 outwardly and downwardly. Thus, a difference in pressure between the top and bottom of the follower 40 will move it downwardly, at which time the rollers move back against the action of the springs 63. However, the follower 40 is prevented from moving upwardly by the jamming engagement of the rollers 61 and 62 between the side walls 33 and 34 of the package 30 and shoulders 65 on the follower.

The follower plate 40 also has a port opening 66 therein for restricting flow of propellant fluid therethrough to produce a small pressure differential acting on the top and bottom of the follower to move it donwwardly in the package. However, the port opening 66 is of sufficient size to permit the flow of propellant fluid at a rate to maintain the desired pressure of fluid in the magazine 2 and chamber 3.

FIGS. 4 and 6 illustrate a vibrator in the form of a ball 67 rotatable in a raceway 68. The ball 67 and raceway 68 are located in an annular chamber 69, see FIG. 4, projecting outwardly from the cover 25 for the magazine housing 20 and to which the end of the tube 6 is connected. The raceway 68 of the vibrator is formed as an annular channel in a block 70 which has a port opening 71 entering the annular channel tangentially and an axial outlet port to cause the ball 67 to rotate therein. Such rotation of the ball 67 in the raceway 68 vibrates the cover 25 and housing 20 to which it is attached to insure movement of the projectiles 31 toward the outlet opening 39. While vibration is not essential to the operation of the gun, it reduces friction and thereby increases reliability.

Chamber 69 also has a port opening 73 for delivering propelling fluid to magazine 2 and more specifically into the space above the follower 40 which then flows through the port opening 66 in the latter, the interior of the package 30, chamber 3, flexible tube 5 and barrel 4 in a continuous stream.

As previously described, the outlet from the chamber 3 is formed in one end of the flexible tube 5 and the opposite end of the flexible tube is connected to the barrel 4. Flexible tube 5 may be fomred of any suitable material, and one material found suitable for the purpose is a rubber hose having walls with reinforcing wire mesh and a thin lining of nylon. The tube may be formed, however, of loosely interlocking metal sections with an interlayer and lining of an imperforate yielding material such as a plastic. The internal diameter of the tube 5 is larger than the outside diameter of the projectile 31, so that very little heat is generated by the frictional engagement between the projectile and tubing. However the peripheral wall 46 of the tube 5 cooperates with the periphery of the projectiles 31 to substantially shut off free flow of propellant gas therebetween.

As shown in FIGS. 1 and 3, the barrel 4 is curved throughout its length except for straight section **4*a* adjacent the muzzle end. The barrel 4 is supported at a plurality of points along its length by brackets 78 dependent from the stock 11** and having rings surrounding the barrel.

One or both of the surfaces at the interior of the barrel and exterior of the projectile has rifling thereon to rotate the projectiles as they pass through the barrel. In the embodiment of the invention illustrated in FIGS. 3, 7 and 8, in which the difference in diameter of the barrel and projectile is exaggerated, the rifling is formed on the interior of the barrel by helical ridges 80 plowed up from the barrel wall by a suitble cutting tool and having a pitch corresponding to one complete revolution for each two inches longitudinally of the barrel. The exterior surface of the projectile, on the other hand, is a plain surface. As the projectile 31 tends to go through the barrel 4 in a straight line, the curvature of the barrel causes the periphery of the projectile to bear against one side of its bore and thereby against the helical ridges 80 which induce a rotation of the projectile as it tends to move forwardly. The straight end section **4*a* of the barrel then directs the rotating projectile in a straight path a slight distance below the line of sights 14 and 15**. It will be understood that a conventional gun barrel may be used in the gun described above, and that the curved barrel illustrated and described may be used in conventional guns. One form of the invention now having been described in detail, the mode of operation will be explained.

With the gun mounted on the person in the manner illustrated in FIG. 1, let it be assumed that the magazine 2 is filled with a self-contained package 30 of projectiles 31 in the manner shown in FIG. 2 and that the forward end of the flexible tube 5 is in a position to close the breech opening 45 of chamber 3. Stop valve 8 is then opened to connect the source of propellant gas at high pressure to the top of the magazine 2 through connecting tube 6. The gas then flows through the chamber 69 in the cover 25 for the housing 20, see FIG. 4, and then through the port 73 onto the top of the follower 40, through port 66 in the follower and between the projectiles toward the outlet 39 from the package 30. When the pressure in the package 30 exceeds the shear strength of the frangible closure 42, the latter is blown from the outlet end of package 30, but the chamber 3 closed by the end of tube 5 stops the flow of propellant fluid. To initiate operation of the gun the flexible tube 5 is rotated as by rotating the barrel 4 to align the breech opening 45 of chamber 3 with the outlet opening 39 from magazine 2. The propellant gas, such as compressed air, then flows into chamber 3 and carries the frangible closure with it outwardly through the chamber, flexible tube 5 and barrel 4 where it is discharged. The propellant gas then flows in a continuous stream from the tank 1 through the magazine 2, chamber 3 and barrel 4 in a continuous stream, as controlled by the gas pressure regulator 7.

As the propellant gas flows through the outlet opening 39 from magazine 2, it carries projectiles with it into the chamber 3. The force of the rapidly flowing propellant gas together with the forwardly curved rearward wall 47 of the chamber 3 engaging the rearward end of each projectile 31 as it enters the chamber produce a forward thrust on the projectile 31 as it enters the chamber 3. This forward thrust on the projectile 31 forces its forward end into the peripheral wall 46 surrounding the chamber at the forward end of the breech opening 45 to substantially shut off the flow of gas which then captures the projectile and carries it forwardly to the stream. The next adjacent projectile then enters the chamber 3 and is thrust forwardly in the same manner, so that the flexible tube 5 and barrel 4 are filled with successive slugs of gas and projectiles being accelerated forwardly by the rapidly expanding gas. During such operation, gas escapes through port opening 71 tangentially into the raceway 68 to rotate ball 67 and produce a vibration which augments the flow of projectiles from the magazine 2 into the propellant chamber 3. The difference in pressure acting on the top and bottom of follower 40 forces it and the projectiles 31 ahead of it toward the outlet opening 39.

As each projectile 31 passes through the curved barrel 4,, it presses against the helical ridges 80 in the barrel 4 to induce rotation of the projectile after which it is directed by the straight section **4*a*** in a straight path.

Firing of the projectiles is continued at a rapid rate, which may be stopped at any time by turning the flexible tube 5 constituting a gate valve across the mouth of the outlet openin 39 from the magazine 2; and may again be started by rotating the tube in the opposite direction. Furthermore, the rate of firing may be controlled by varying the pressure of the propellant fluid by adjusting the pressure regulator 7, or it may be controlled by changing the shape of the breech opening 45 and rearward wall 47 of chamber 3.

When the supply of projectiles from the package 30 has been exhausted, the stop valve 8 is closed, the magazine quickly opened by turning the cover 25 relative to the magazine housing 20 until the interlocking flanges 26 and 27 are disengaged and the cover moved axially relative to the magazine housing 20 until the two are no longer attached. Package casing 32 is removed, another package of projectiles inserted in its place, cover 25 applied to the open end of the housing and turned to locked position and the stop valve 8 opened as previously explained. The gun may then be operated in the manner previously explained.

It has been found that a gun made in accordance with the present invention and adapted for firing projectiles of standardized configuration with respect to said gun and having the shape illustrated and having diameter of 0.138 inches and using a pressure of 4,000 psi, will produce a muzzle velocity approaching 2,000 feet per second and have a lethal range of greater than 400 yards. With a pressure in chamber 3 as low as 1,000 psi the gun will fire 190 projectiles per second in a reproducible manner and fire a full magazine of 440 projectiles in a single burst in approximately 2.3 seconds. It will be understood that the magazine housing 20 may have other shapes and contain a greater number of projectiles. For purposes of description, a single package 30 of projectiles 31 only has been shown, but it will be understood that a greater number of packages may be used in the magazine 2 and arranged to feed successively into the chamber 3.

FIGS. 9 and 10 illustrate a magazine **2*a* and propelling chamber 3*a* of modified construction in which the chamber is formed in a cylinder 82 independent of the barrel 4 and flexible tube 5. The cylinder 82 is mounted to rotate in the lower end of the magazine housing 20*a* similar to the flexible tube 5 in FIG. 3 but entirely enclosed therein. Cylinder 82 is rotated to start and stop operation of the gun by a handle 83 projecting radially therefrom through a slot 84 in the housing strap 24*a* and the ends of the cylinder are sealed in the housing by means of O-rings 85 and 86. The modified construction of FIGS. 9 and 10 has a forwardly curved wall 47*a* at the rear of the chamber 3*a* like the curved wall 47 in FIG. 3 and the gun operates in the same way as previously explained, except that the barrel 4 and flexible tube 5** need not be turned to start and stop operation.

FIG. 11 shows another modified construction in which the outer periphery of the projectile 31' has rifling 90 on its outer periphery for engagement with the smooth bore 91 of the barrel **4*b* to induce rotation in the projectile as it passes through the barrel. The peripheral rifling 90 on the projectiles 31' may be helically scored grooves or cut edges like the ridges 80 illustrated in FIG. 8** in the bore of the barrel.

FIG. 12 illustrates a further modified construction to provide a trigger control for starting and stopping operation of the gun at a position remote from the propelling chamber 3 such as the hand grip 12 or 13 and for adjusting the location of the surface at the rear of the propelling chamber which kicks the projectiles forwardly.

The modified form of control for starting and stopping operation of the gun comprises a gate 94 operated across the passage at the outlet from the chamber 31 by a spring 95. The opposite side of the gate 94 constitutes a piston which is acted upon by the pressure of propellant fluid in the magazine 2 and supplied through the channel 96. Normally the pressure on the two sides of the gate 94 is balanced by supplying propellant fluid 2 to the spring operated side through a tube 97 having a restriction 98 therein. This latter side of the gate 94 also has a tube 99 connected to an exhaust valve 100 operated by a trigger 101. When the trigger 101 is pressed against the spring 102 to open the exhaust valve 100, it releases pressure on the spring operated side of the gate 94 so that the pressure of propellant fluid acting on the other side of the gate moves it to an open position. At the same time the restriction 98 limits the escape of propellant fluid toward the exhaust valve to a negligible quantity and produces a difference in pressure. When the exhaust valve 100 is closed, the pressure will equalize at opposite sides of the gate 94 so that the spring 95 will move it to closing position.

The adjustable surface for kicking the projectiles forwardly comprises the rounded forward end 103 of a pin 104 projecting forwardly into the rear of the chamber **3*c*. The pin 104 projects forwardly from a threaded stud 105 rotatable in a tapped hole in the magazine housing 2*c*. Thus, by turning the knurled head of the stud 105 the position of the rounded end 103 of pin 104** engaged by the rearward ends of the projectiles may be adjusted to insure delivery of projectiles from the propelling chamber 3c and to adjust the rate of delivery and the velocity of the projectiles.

FIG. 13 illustrates a modified lug 106 and hook 107 construction on the housing 20d and cover 25d of the magazine for locking the cover in closed position to form a pressure vessel.

Figure 14:
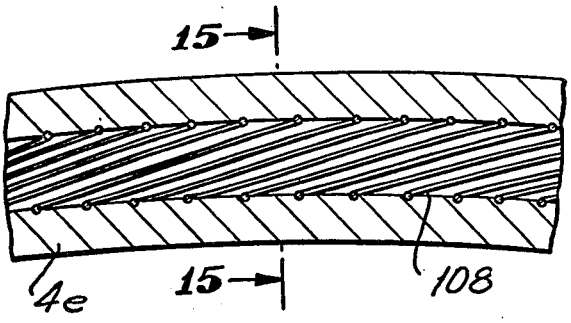
FIG. 14 is a view similar to FIG. 7 showing the rifling in a portion of the barrel formed by helical wires attached to the bore of the barrel.
Figure 15:
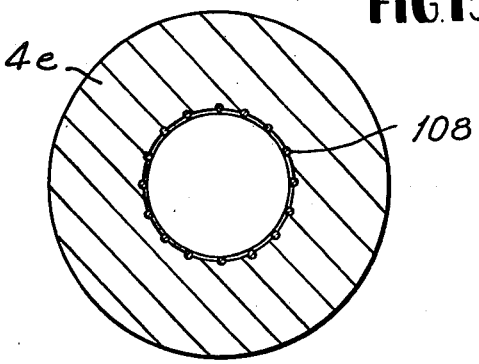
FIG. 15 is a transverse sectional view taken on line 15—15 of FIG. 14 to show the ends of the wires forming the rifling.

FIGS. 14 and 15 illustrate a still further modified construction in which the rifling on the interior of the barrel 4e is formed by fine wires 108 arranged helically in the barrel and attached to the bore. The barrel 4e in this modified construction is also curved to cause the projectiles to engage and bear against the rifling wires 108 as they tend to move in a straight line through the barrel.

Figure 16:
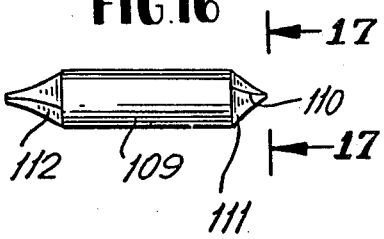
FIG. 16 is a side elevational view of a projectile of modified form having helical ridges in its forward and rearward ends with the same lead angle as it has in flight for increasing penetration without affecting its rotation or stability.
Figure 17:
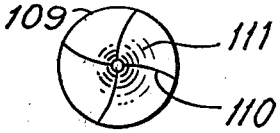
FIG. 17 is a front elevational view of the projectile illustrated in FIG. 16 to show the spiral cutting edges at its forward end.

FIGS. 16 and 17 show a projectile 109 of modified construction in which the ogive shaped forward end of the projectile has helical cutting edges 110 formed by grooves scored therein, or by cutting helical recesses 111 in the nose of the projectile. Similarly the rearward or boat end of the projectile may have grooves 112 cut therein. Such shaping of the forward end of the projectile 109 tends to produce a greater penetration than a smooth nosed projectile. The cutting edges 10 are cut at an angle to provide a lead corresponding to the lead of the projectile in flight. In addition to the projectiles described, it will be understood that other forms of projectiles may be used, such as darts, flechettes or even balls.

Figure 18:
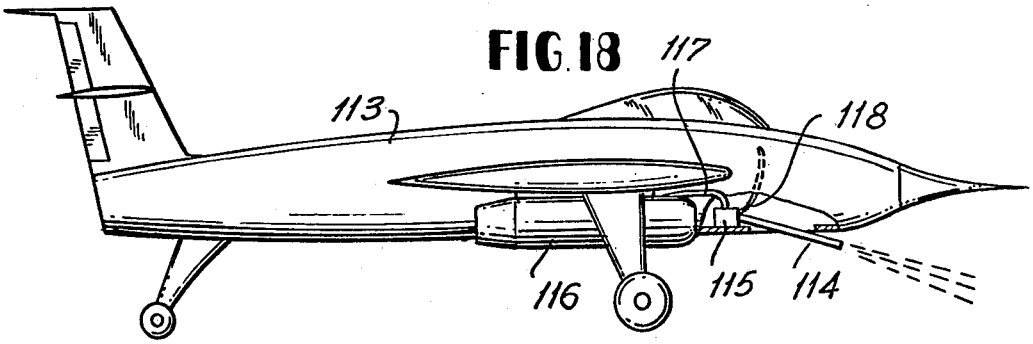
FIG. 18 shows the gun mounted on a jet aircraft and utilizing compressed air for an engine as the propellant for the gun.

FIG. 18 illustrates the gun applied to an aircraft 113. In this installation the barrel 114 of the gun has a magazine 115 like that described above for supplying projectiles and the motive fluid supplied to the magazine may be compressed air for the jet engine 116 or products of combustion at the pressure in the combustion chamber. The supply of motive fluid is delivered from the jet engine 116 through the conduit 117. In this application the projectile will have the velocity of the aircraft in addition to its muzzle velocity.

Figure 19:
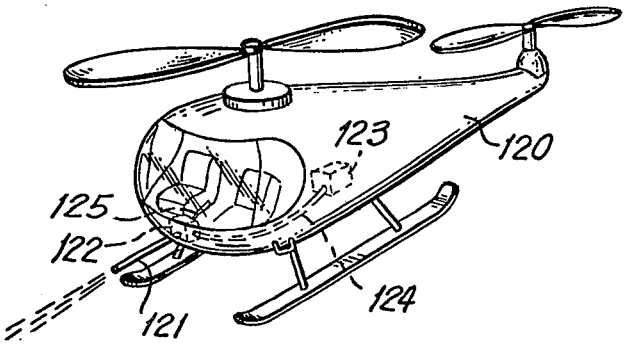
FIG. 19 shows the gun mounted on a helicopter having a generator therein for supplying fluid propellant.

FIG. 19 illustrates still another installation of the gun of the present invention on a helicopter 120. In this installation the barrel 121 is shown mounted on the underside of the helicopter and is supplied with projectiles from a magazine 122. Motive fluid, such as high pressure gas, is supplied to the magazine from a chemically actuated gas generator 123 through a conduit 124.

It will now be observed that the present invention provides an improved light weight gun which may be fired at a much more rapid rate than conventional guns and one capable of operation without moving parts excet those required to start and stop the flow of propellant gas. It will further be observed that the present invention provides a rapid fire gun which greatly increases the number of projectiles that can be carried on the person and loaded in the gun at one time as a self-contained package. It will be still further observed that the present invention provides a gun having an improved barrel construction for inducing rotation of the projectiles as they move through the barrel without danger of jamming due to overheating and which eliminates the necessity of cartridge casings and powder. It will still further be observed that the present invention provides a rapid fire gun which may be adjusted to regulate the rate of firing and adapted for many applications such as jet aircraft, vehicles, helicopters and the like. It will still further be observed that the present invention provides a rapid fire gun of the type indicated which is of relatively simple and compact construction to adapt it for economical manufacture and one which is highly reliable in operation in performing its intended function.

While several embodiments of the invention have been herein illustrated and described, it will be understood that further changes may be made in construction and arrangement of elements as well as in the application of the gun without departing from the spirit or scope of the invention. Therefore, without limitation in this respect, the invention is defined by the following claims:

We claim:

1. A gun capable of firing elongated projectiles at a rapid rate, comprising a barrel having a bore of a given diameter with openings at the front and rear thereof, said gun having a loading chamber of substantially the given diameter of said bore and having a forward opening connected to the rear opening of said bore, a side breech opening which opens into the side of said chamber and being effectively the only opening into said chamber apart from said forward opening, said side breech opening having a forward to rearward dimension at least twice as great as said given diameter, said gun having a passageway connected to said side breech opening of at least said forward to rearward dimension, a gas-source opening into said passageway spaced a substantial enough distance from said side breech opening to be clearly separate from said side breech opening, supply means for supplying motive gas under pressure connected to said gas-source opening for directing gas under high pressure through said passageway, in said side breech opening, through said chamber, and out said bore.

2. A gun according to claim 1 further comprising a surface in the rearward end of said chamber opposite said forward opening thereof, said surface sloping inwardly and forwardly from said breech opening in a shape adapted to engage the rearward end of a projectile and feed it into said bore.

3. A gun in accordance with claim 1 mounted on a helicopter, and means on the helicopter for producing high pressure gas and connected to supply it to operate the gun.

4. A gun according to claim 1, further comprising a flexible tube extending the bore of said gun between the forward end of said chamber and said barrel, forming a continuous flow passage therebetween.

5. A gun according to claim 4, wherein the barrel has helical ridges formed on its inner periphery to provide rifling in the gun barrel.

* * * * *